US005179242A

United States Patent [19]

Usa

[11] Patent Number: 5,179,242

[45] Date of Patent: Jan. 12, 1993

[54] METHOD AND APPARATUS FOR CONTROLLING SOUND SOURCE FOR ELECTRONIC MUSICAL INSTRUMENT

[75] Inventor: Satoshi Usa, Hamamatsu, Japan

[73] Assignee: Yamaha Corporation, Hamamatsu, Japan

[21] Appl. No.: 713,131

[22] Filed: Jun. 10, 1991

[30] Foreign Application Priority Data

Jun. 13, 1990 [JP] Japan ..... 2-152645
Jun. 26, 1990 [JP] Japan ..... 2-165568

[51] Int. Cl.[5] ..... G10H 1/18; G10H 1/46

[52] U.S. Cl. ..... 84/658; 84/665; 84/DIG. 9

[58] Field of Search ..... 84/600, 615, 622-633, 84/658-665, 687-690, 692-711, 735-742, DIG. 9

[56] References Cited

U.S. PATENT DOCUMENTS 4,875,400 10/1989 Okuda et al. ..... 84/665 X
5,058,480 10/1991 Suzuki et al. ..... 84/600

FOREIGN PATENT DOCUMENTS 0248527 4/1987 European Pat. Off. .
2-285399 11/1990 Japan .

*Primary Examiner*—Stanley J. Witkowski
*Attorney, Agent, or Firm*—Graham & James

[57] ABSTRACT

In controlling a sound source for an electronic musical instrument, operation data of a performance operation member corresponding to musical tone control parameters of a musical instrument is converted according to a tone generation region characteristic of the musical instrument. The tone generation region is approximated as a closed region defined by one or more curves. The converted data is inputted to a sound source circuit of the electronic musical instrument, so that a musical tone from pianissimo up to fortissimo can be generated sufficiently, while the musical tone approximates that of the musical instrument.

14 Claims, 14 Drawing Sheets

START

206

CALCURATE SOUND SOURCE PARAMETERS em AND pr BASED ON PERFORMANCE OPERATION MEMBER DATA. FORMULAS ARE AS FOLLOWS $$base_{em} = s\ell\ speed \times s\ell\ press \cdots\cdots (13)$$

$$base_{pr} = [(au + m \times a\ell) \times s\ell\ speed^2 \times s\ell\ press^2 + (bu + m \times b\ell) \times s\ell\ speed \times s\ell\ press + cu + m \times c\ell] \times \frac{1}{(m+1)} \cdots\cdots (15)$$

$$\text{ONE OF } em_u = \frac{1}{2 \times au}\left(-bu \pm \sqrt{bu^2 - 4au \times (cu - base_{pr})}\right)$$

$$\text{SATISFYING } em_{min} \leqq em_u \leqq 32767 \cdots\cdots (17)$$

$$\text{ONE OF } em_\ell = \frac{1}{2 \times a\ell}\left(-b\ell \pm \sqrt{b\ell^2 - 4a\ell\ (c\ell - base_{pr})}\right)$$

$$\text{SATISFYING } em_{min} \leqq em_\ell \leqq 32767 \cdots\cdots (18)$$

if (kv > 0)

$$vib_{em} = (em_\ell - base_{em}) \times kv \cdots\cdots (19)$$

$$\text{e}\ell\text{se} \quad vib_{em} = (base_{em} - em_u) \times kv \cdots\cdots (20)$$

$$pr = base_{pr} \cdots\cdots (21)$$

$$em = base_{em} + vib_{em} \cdots\cdots (22)$$

if (s ℓ press ≠ 0 { if $(pr < pr_{min})$ $pr = pr_{min}$ ··· (23)

if $(em < em_{min})$ $em = em_{min}$ ··· (24)

}

END

FIG. 13

METHOD AND APPARATUS FOR CONTROLLING SOUND SOURCE FOR ELECTRONIC MUSICAL INSTRUMENT

BACKGROUND OF THE INVENTION

1. Field of the Invention

The present invention relates to a method and an apparatus of controlling a sound force for an electronic musical instrument, more particularly, to an improvement with which a sound source circuit can always normally generate tone signals on the basis of input data such as positions or pressures corresponding to musical tone parameters from a performance operation member, and to an electronic musical instrument using a so-called physically modelled sound source as a sound source for forming a tone waveform, more particularly, to an electronic musical instrument which has a wide dynamic range of a tone volume to be able to stably and easily generate tones from a very weak tone such as a pianissimo tone up to a very strong tone such as a fortissimo tone.

2. Prior Art

An electronic musical instrument which generates performance tones of a rubbed string instrument such as a violin or of a wind instrument such as a clarinet comprises, as a musical tone waveform signal generating means a physically modelled sound source for physically simulating a mechanical vibration system of the rubbed string instrument or an air vibration system of the wind instrument by an electrical circuit. In an electronic musical instrument of this type, pitch data of an ON key is inputted upon operation of a keyboard, and a musical tone control signal (musical tone parameter) corresponding to a bow pressure or a bow velocity of a bowing operation in the rubbed string instrument, or a breath pressure or an embouchure of a blowing operation in the wind instrument is inputted to a sound source by a performance operation member comprising, e.g., a slide volume, thereby generating and producing an electronic tone.

The physically modelled sound source has parameters in physical images, such as a bow pressure, a bow velocity, a breath pressure, an embouchure, and the like, and changes these parameters, thereby variously and naturally changing tone colors in accordance with a tone volume, the way of performance, a time elapsed from the beginning of tone generation, or the like as in acoustic instruments.

However, in a conventional electronic musical instrument in which a musical tone control signal based on an operation position or an operation pressure of a performance operation member is merely multiplied with a given coefficient regardless of a velocity or pressure region, and is directly inputted to a sound source, a tone cannot be generated or an irregular or abnormal tone such as an uncomfortable tone or a so-called falsetto tone is generated in a given operation region. Therefore, in the conventional electronic musical instrument having the physically modelled sound source, the performance operation member must be operated while avoiding generation of these irregular or abnormal tones, thus making a performance operation difficult.

The present inventors proposed a method of controlling a sound source for an electronic musical instrument which was characterized in that operation member data of a performance operation member corresponding to a musical tone parameter was corrected on the basis of tone generation region characteristics according to an instrument, and corrected data was inputted to a sound source circuit, and filed this method in U.S. Ser. No. 07/648,156. According to this method, a musical tone parameter can be corrected to data within a predetermined tone generation region such as a tone generation start region, a tone generation sustain region, or the like, and then, the corrected parameter can be inputted to a sound source. Thus, the sound source can normally generate tones regardless of an operation state of the operation member.

This prior application presents an embodiment wherein boundaries of a tone generation region are approximated by two straight lines, and a region between the two straight lines is set to coincide with a region which can be defined by a corrected data value. However, boundaries of some tone generation region patterns cannot be approximated by only two straight lines with sufficient precision depending on an algorithm of a physically modelled sound source.

For example, FIG. 18 shows the relationship among a breath pressure, an embouchure, and a sound pressure of a saxophone. As shown in FIG. 18, a tone generation region of the saxophone has a relatively complicated pattern. Therefore, it can be estimated that as a physically modelled saxophone sound source approximates an air vibration system of the saxophone better, the tone generation region pattern of the sound source approaches that shown in FIG. 18. For example, the tone generation region in the physically modelled saxophone sound source having an arrangement shown in FIG. 2 is as shown in FIG. 3.

It is impossible to approximate the boundaries of the tone generation region by only two straight lines with sufficient precision like in the embodiment of the prior application. If the tone generation region is approximated by only two straight lines, the approximating straight lines undesirably pass inside the boundaries of the tone generation region, as indicated by dotted lines a and b in FIG. 3, so that corrected data does not include values in a non-generation region and in an irregular tone region as much as possible. In this case, a musical tone control parameter (corrected data) cannot be sufficiently changed up to near the boundaries in the original tone generation region, and a variable range of a tone color is undesirably narrowed. For example, hatched portions B and C in FIG. 3 respectively correspond to a region of a soft tone color, and a region of a hard, strong tone, and a tone color is largely changed in these regions. However, since these regions are located almost outside the straight lines, data in these portions cannot be adopted as corrected data. More specifically, since most of regions where a tone color is largely changed are omitted, expression power is impaired.

In the embodiment of the prior application, as one of two different musical tone parameters, data from the operation member is directly used, and the other parameter is corrected to fall within a region obtained by approximating the tone generation region. For this reason, an actual performance cannot always match with musical tones.

Furthermore, parameters such as a bow velocity, a bow pressure, a breath pressure, an embouchure, and the like have upper and lower limit values which are used by the sound source to start or sustain tone generation. For example, when the parameter is equal to or smaller than a given value, it does not satisfy an oscillation condition of the model, and no tone is generated. On the other hand, when the parameter value is set beyond an oscillation limit, even if the value corresponds to the lower limit value of the oscillation limit, a tone volume of a generated tone is relatively large. Since the embodiment of the prior application does not take the lower limits of these parameters into consideration in the control, the dynamic range of a musical tone is narrowed, and a performance with weak tones such as pianissimo tones cannot be performed, or tones are intermittently generated if possible. When the upper limit value is exceeded, no tone is generated, or an uncomfortable irregular tone is generated.

SUMMARY OF THE INVENTION

The present invention has been made in consideration of the conventional drawbacks, and has as its first object to provide a method of controlling a sound source for an electronic musical instrument, which can always realize a performance in a normal tone generation state regardless of an operation state of a performance operation member, has a wide variable range of a tone color, can attain a stable pianissimo performance, and can generate musical tones matching with an operation state of the operation member in an actual performance.

It is the second object of the present invention to provide an electronic musical instrument which has a wide dynamic range of performance tones, and allows an easy performance with weak tones such as pianissimo tones.

In order to achieve the first object, according to the first aspect of the present invention, in a method of controlling a sound source for an electronic musical instrument in which operation member data of a performance operation member corresponding to a musical tone parameter is corrected on the basis of tone generation region characteristics according to an instrument, and then, the corrected data is inputted to a sound source circuit, the tone generation region is approximated as a closed region defined by one or a plurality of curves, and the operation member data is converted into data within the closed region to obtain the corrected data.

In the first aspect, the corrected data is obtained as a function of, e.g., each of a plurality of performance operation member data.

With the above arrangement, since boundary lines of the tone generation region are approximated by curves such as a high-order function (e.g., a quadratic function, or higher), approximation precision can be improved. Since the approximation precision can be improved, a corrected parameter value can be substantially changed to the boundary lines of the tone generation region, and a variation range of a tone color can be widened, thus improving expression power. Since the approximation precision can be improved, a stable pianissimo performance can also be attained.

Furthermore, if the corrected data serving as a sound source parameter is defined as a function of each of a plurality of performance operation member data, and these functions are appropriately set, a natural relationship can be accomplished between a performance operation and tones, thereby improving play feeling.

In order to achieve the second object, according to the second aspect of the present invention, an electronic musical instrument using a physically modelled sound source, comprises control signal correction means for correcting an operation member signal so that a musical tone parameter for driving the physically modelled sound source can satisfy an oscillation condition of the physically modelled sound source in a tone generation state, and tone volume control means for controlling an amplitude of a musical tone waveform signal formed upon oscillation of the physically modelled sound source on the basis of a value obtained by correcting the operation member signal.

With this arrangement, since the musical tone parameter for driving the physically modelled sound source is corrected to always satisfy the oscillation condition of the physically modelled sound source in a tone generation state, for example, not to exceed an oscillation lower limit, tones can be prevented from being stopped or intermittently generated. In other words, correction is made to stabilize tone generation (oscillation). Furthermore, the output from the physically modelled sound source is controlled by the tone volume control means to obtain a desired tone volume intended upon operation of the operation member.

Therefore, according to the second aspect, a dynamic range wider than a dynamic range of a tone obtained by controlling only a parameter of the physically modelled sound source or a dynamic range of an acoustic instrument simulated by the physically modelled sound source can be obtained. In particular, a performance with weak tones such as pianissimo tones can be easily and stably made.

In an acoustic instrument, for example, not only a tone volume but also a tone color is changed within a range between mezzo forte (mf) and fortissimo (ff). However, in a range below piano (p), only a tone volume is changed. Therefore, when tones are generated in a tone volume below piano (p), the physically modelled sound source can be operated in a region where it can be oscillated in a tone volume below piano (p). As a result, the relationship between a tone volume and a tone color can be prevented from becoming unnatural, and characteristics of the physically modelled sound source will not be impaired.

BRIEF DESCRIPTION OF THE DRAWINGS

FIG. 13 is a flow chart of a sound source control routine;

DETAILED DESCRIPTION OF THE PREFERRED EMBODIMENTS

An embodiment of the present invention will be described in more detail with reference to the accompanying drawings. [First Embodiment]

Figure 1:
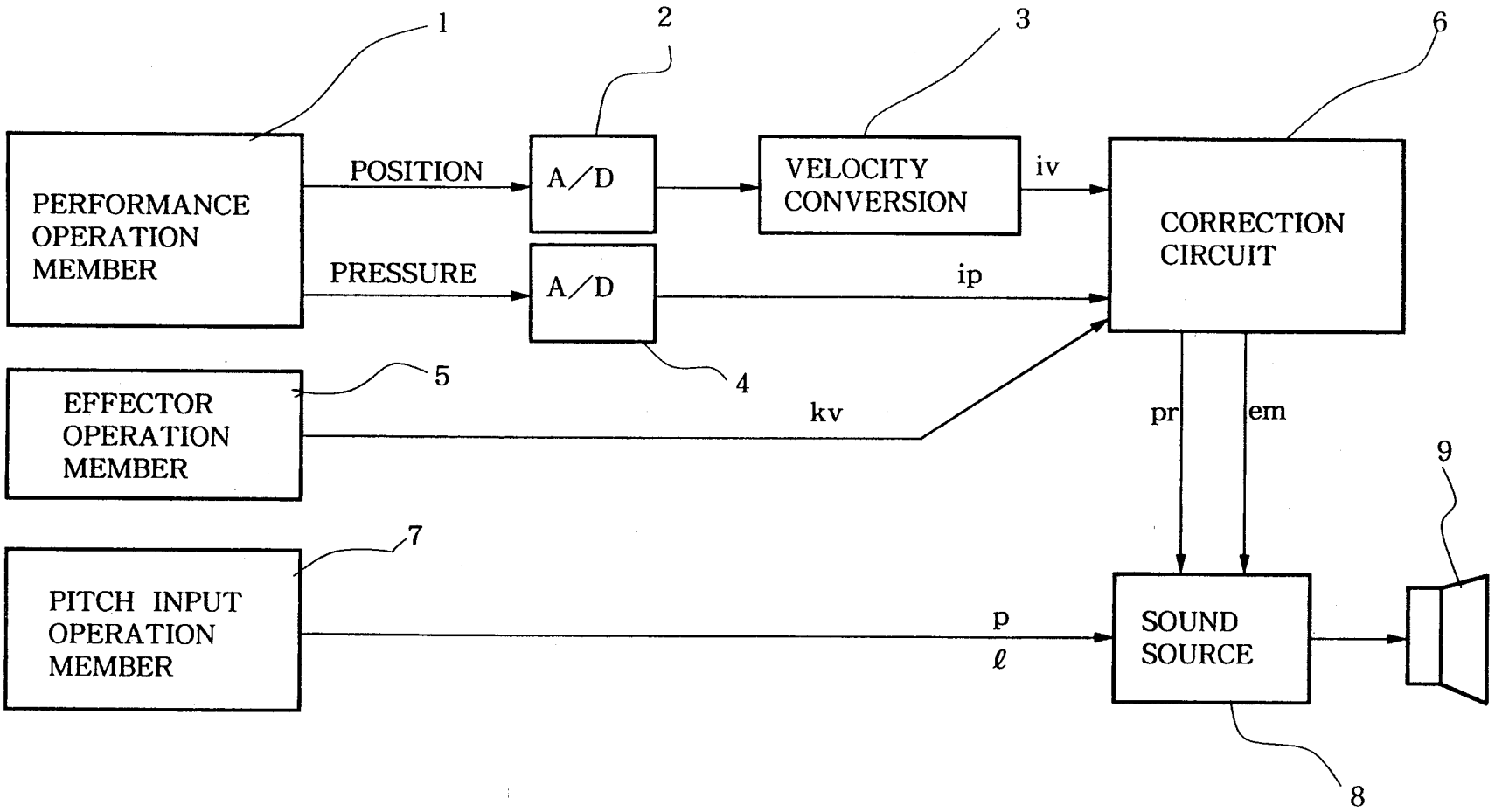
FIG. 1 is a block diagram showing the basic arrangement of an electronic musical instrument control mechanism according to the first embodiment of the present invention.

FIG. 1 is a block diagram of an electronic wind instrument according to the first embodiment of the present invention.

In FIG. 1, a performance operation member 1 comprises, e.g., a slide volume or joystick mechanism or a mouse mechanism comprising a pressure sensitive means. Position data generated upon operation of the operation member 1 is converted into velocity data (iv) via an A/D converter 2 and a velocity conversion time differential circuit 3, and the velocity data is inputted to a correction circuit 6. Pressure data from the pressure sensitive means of the operation member 1 is converted into pressure data (ip) via an A/D converter 4, and the pressure data is inputted to the correction circuit 6.

An effector operation member 5 is, for example, a pitch bender as one of performance operation members, and comprises a known wheel, a roll bar described in Japanese Patent Application Laid-Open Gazette No. (Hei.) 2-285399 described above, or the like. Effector data such as vibrato data (kv) outputted from the effector operation member 5 is also inputted to the correction circuit 6.

The correction circuit 6 corrects the velocity data (iv) and the pressure data (ip) to fall within a predetermined tone generation region (tone generation start or sustain region), and inputs them as embouchure data (em) and breath pressure data (pr) to a physically modelled sound source 8. Upon reception of the vibrato data (kv) from the effector operation member 5, the correction circuit 6 periodically changes the embouchure data (em) so as not to fall outside the tone generation region (tone generation sustain region).

A pitch input operation member 7 comprises, e.g., a keyboard. Data outputted from the pitch input operation member 7 is inputted to the sound source 8 as pitch data (p) or tube length data (l). When the correction circuit 6 can set different tone generation regions in accordance with pitches or tone ranges, the pitch data (p) or the tube length data (l) is also inputted to the correction circuit 6, and is also used for selecting a tone generation region. Note that a lateral vibration keyboard (to be described later) has both the functions of the pitch input operation member 7 and the effector operation member 5.

The sound source 8 comprises a so-called saxophone algorithm physically modelled sound source for simulating an air vibration system of a saxophone by an electrical circuit, and generates electronic tones on the basis of the embouchure data (em), the breath pressure data (pr), the pitch data (p), and the like. The electronic tones are produced as actual tones via a sound system 9.

Figure 2:
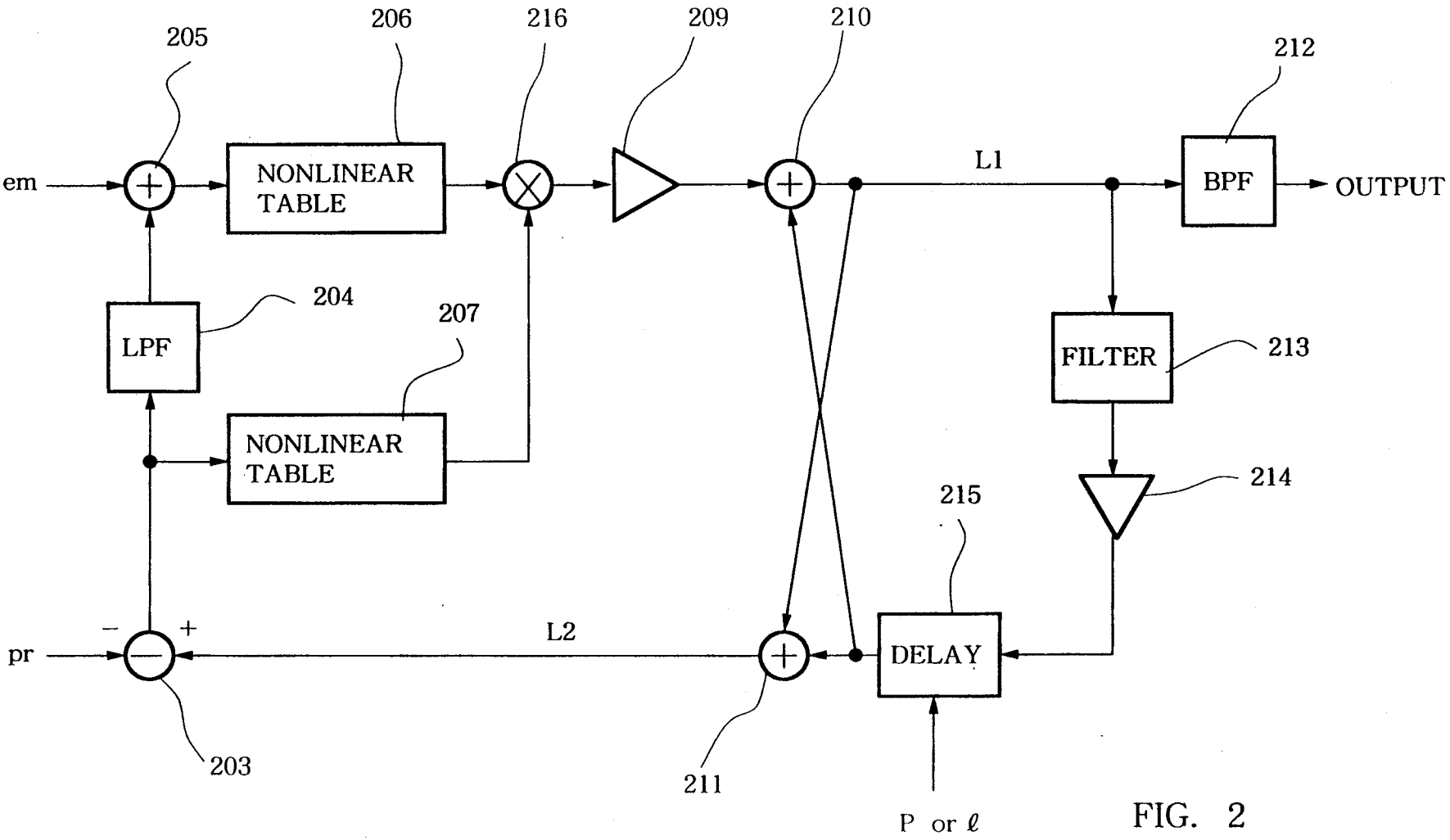
FIG. 2 is a block diagram of a saxophone algorithm physically modelled sound source.

FIG. 2 is a block diagram showing a saxophone algorithm sound source circuit used as the sound source 8. In FIG. 2, a subtractor 203 and an adder 205 constitute an input unit of the sound source circuit. The breath pressure signal (pr) and the embouchure signal (em) corrected by the correction circuit 6 (FIG. 1) are respectively inputted to the subtractor 203 and the adder 205. The subtractor 203 subtracts the breath pressure signal from a signal inputted through a signal line L2, thereby outputting a differential pressure signal which simulates a differential pressure for displacing a reed of a mouthpiece. A low-pass filter (LPF) 204 is connected to the output from the subtractor 203, and removes high-frequency components of the differential pressure signal. This is because the reed does not respond to high-frequency components. The adder 205 adds the embouchure signal and the output from the LPF 204, and outputs the sum to a nonlinear table 206. The nonlinear table 206 simulates a displacement of the reed in accordance with a given pressure, and has predetermined input/output (I/O) characteristics. The output from the nonlinear table 206 serves as a signal representing an air path area in the reed of the mouthpiece. The output from the nonlinear table 206 is connected to one input of a multiplier 216. The other input of the multiplier 216 receives the differential pressure signal from the subtractor 203 via a nonlinear table 207. The nonlinear table 207 simulates a phenomenon in that even if a differential pressure is increased, a flow rate is saturated in a narrow tube path, and the differential pressure is not proportional to the flow rate. On the basis of these two input signals, the output signal from the multiplier 216 serves as a signal representing an air flow rate in the reed of the mouthpiece.

The multiplier 216 is connected to an adder 210 via an attenuator 209. The adder 210 constitutes a junction together with an adder 211. The adder 210 adds an output signal from a delay circuit 215 constituting the signal line L2, and an output signal from the attenuator 209, and outputs the sum signal onto a signal line L1. The other adder 211 adds a signal on the signal line L1, and a signal from the delay circuit 215, and outputs the sum signal onto the signal line L2. This loop can simulate a pressure obtained by synthesizing an incident wave based on an input flow rate immediately after a gap between the mouthpiece and the reed, and a reflection wave from a resonance tube.

The signal on the signal line L1 is fed back to the signal line L2 via a filter 213, an attenuator 214 and the delay circuit 215. The filter 213 comprises a low-pass filter or a combination of a low-pass filter and a high-pass filter. The filter 213 simulates the shape of the resonance tube. The delay circuit 215 receives the pitch data (p) or the tube length data (l) from the pitch input operation member 7 (FIG. 1). The delay circuit 215 simulates a state wherein an incident wave from the mouthpiece is returned to the mouthpiece as a reflection wave in correspondence with the length of the resonance tube, and the length between the edge portion of the resonance tube and a tone hole.

A waveform signal on the signal line L1 is extracted as an electronic tone output via a band-pass filter (BPF) 212 for simulating radiation characteristics of a musical tone in air.

Tone generation region correction in the correction circuit 6 will be explained below. The feature of the physically modelled sound source, and the drawbacks of a correction circuit used in the embodiment of the prior application will be described below.

① Boundary of Tone Generation Region

Figure 3:
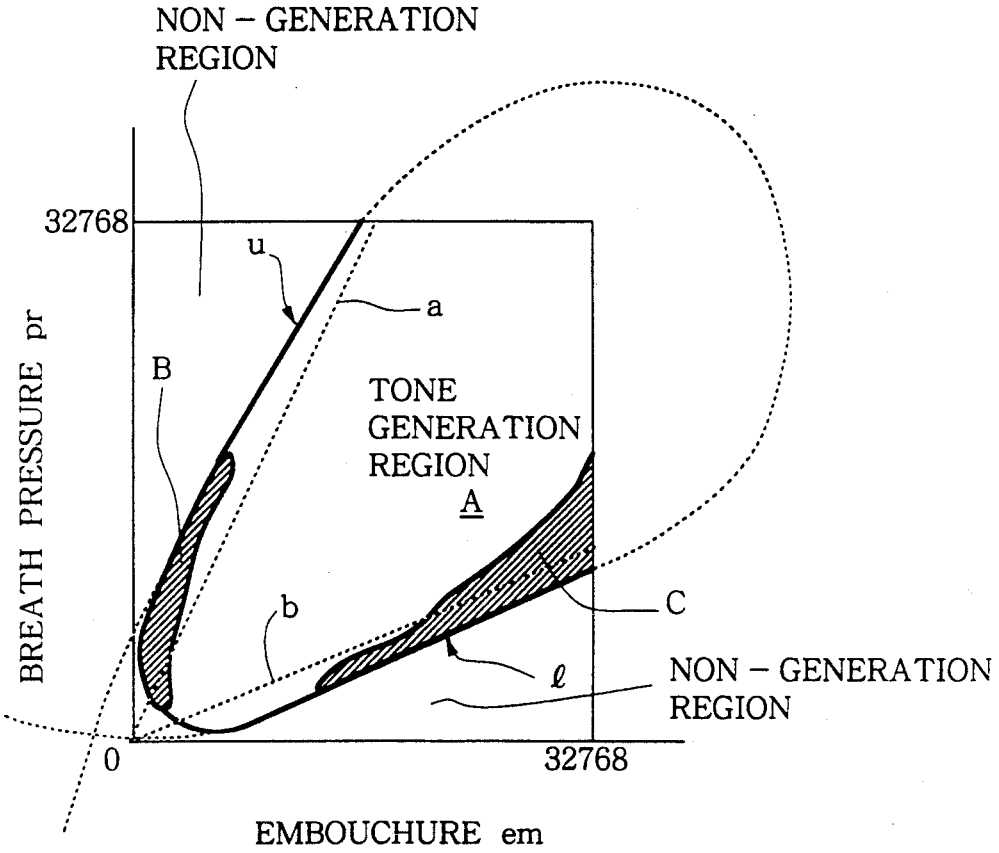
FIGS. 3 and 4 are graphs showing tone generation region characteristics of a saxophone algorithm.

A physically modelled sound source has different tone generation region patterns depending on algorithms. For example, when a tone generation region of the saxophone algorithm shown in FIG. 2 is illustrated in an embouchure (em).breath pressure (pr) plane, it becomes a region A within an inclined egg- or parabolic-shaped boundary curve, as indicated by solid curves in FIGS. 3 and 4. As can be seen from a difference between FIGS. 3 and 4, the tone generation region pattern is merely enlarged, reduced, and moved while maintaining substantially the same pattern in accordance with a change in interval. As indicated by hatched portions in FIG. 3, a region B of a soft tone color, a region C of a hard, strong tone color, and the like are distributed near the boundary curve. If this boundary curve is simply approximated by straight lines, it becomes as indicated by, e.g., dotted lines a and b, and the regions B and C where a tone color is largely changed are undesirably omitted, thus impairing expression power. A region where the embouchure (em) and the breath pressure (pr) are relatively large, i.e., an upper right region in FIG. 3, corresponds to a non-generation or irregular tone generation region. In the approximation using straight lines, such a region cannot be discriminated from the tone generation region. Therefore, data in the non-generation or irregular tone generation region may often be inputted to the sound source as corrected data, and the sound source cannot always normally generate tones.

In this embodiment, the boundary of the tone generation region is approximated by two parabolas, so that the approximated boundary is closer to an original tone generation region boundary, thereby assuring a wide variable range of a tone color. In addition, the tone generation region is defined as a closed region, so that the musical tone parameter can be corrected to always fall within the tone generation region. When a boundary curve has a more complicated pattern, functions of higher orders may be used, or sampling points of the boundary may be spline-interpolated.

When a parabola is inclined, an actual calculation volume is increased. Thus, the boundary of the tone generation region is approximated by two parabolas l and u whose central axes are parallel to the breath pressure (pr) axis.

$$\text{Parabola u: } pr = au \times em2 + bu \times em + cu \quad (1)$$

$$\text{Parabola l: } pl = al \times em2 + bl \times em + cl \quad (2)$$

where au, bu, and cu are the coefficients of the parabola u, and al, bl, and cl are the coefficients of the parabola l.

② Lower Limit of Sound Source Parameter

Figure 5:
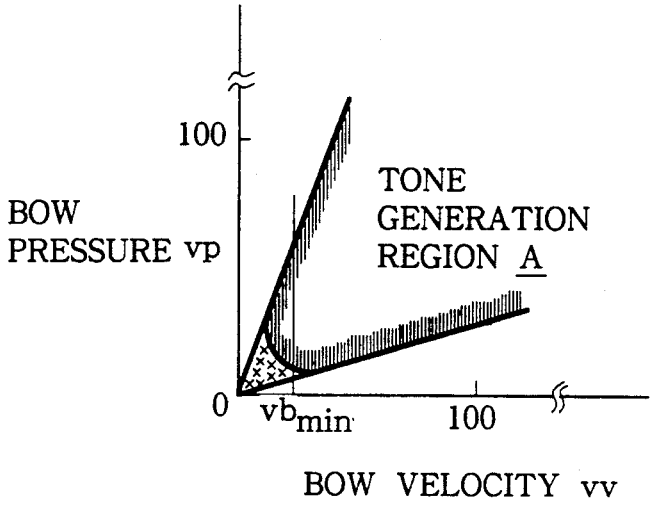
FIG. 5 is a graph showing tone generation region characteristics of a rubbed string algorithm.

As the feature of a physically modelled musical tone, musical tone parameters have lower limits. More specifically, when a musical tone parameter, e.g., the value of a bow velocity, a bow pressure, a breath pressure, an embouchure, or the like is decreased, there is a region where oscillation (tone generation) is stopped even within a region defined by the extended boundary lines a and b approximated by straight lines. FIG. 5 shows a rubbed string algorithm. In FIG. 5, a tone generation region is approximated by straight lines, and is enlarged near the origin. In the rubbed string algorithm, oscillation is stopped within a region with "x" marks. For this reason, in a pianissimo performance, a musical tone parameter repetitively enters the region with the "x" marks and returns to the tone generation region. As a result, tones may often be intermittently generated. For example, control for, when pressure data (ip) from the operation member is other than 0, inhibiting a bow velocity (vv) from being decreased below $vb_{min}$ is made, as indicated by the following relation:

$$\text{if } (ip > 0)\ vv \geqq vb_{min} \quad (3)$$

Thus, the musical tone parameter can be prevented from entering the region with the "x" marks, and pianissimo tones can be stably generated.

③ Relationship between Performance Operation and Tone

If velocity data from the operation member is represented by iv, pressure data is represented by ip, bow pressure data in the rubbed string algorithm of the physically modelled sound source is represented by vv, bow pressure data is represented by vp, and functions are represented by q( ), q'( ), f( ), and g( ), control formulas in the embodiment of the prior application are as follows:

$$\begin{cases} vv = iv & (4) \\ vp = q(iv, ip) & (5) \end{cases}$$

or $$\begin{cases} vv = q(iv, ip) & (6) \\ vp = ip & (7) \end{cases}$$

More specifically, one of data vv and vp from the operation member is directly used, and the other data is controlled to fall within the tone generation region using the function q or q'. However, in this case, operation feeling does not match with generated tones in terms of characteristics of the physically modelled sound source. More specifically, even if a velocity (iv) of the operation member, e.g., a slide volume is directly used as bow velocity data (vv) of the sound source or a pressure (ip) is directly used as bow pressure data (vp) of the sound source, the relationship between the performance operation and tones is unnatural.

Thus, a plurality of sound source parameters are defined as functions of a plurality of performance operation member data, and the functions are appropriately set, so that the natural relationship between the performance operation and tones can be obtained. For example, $$\begin{cases} vv = g(iv, ip) & (8) \\ vp = f(iv, ip) & (9) \end{cases}$$

Operation formulas for arithmetic operations executed for correcting the tone generation region in the correction circuit 6 shown in FIG. 1 will be described below.

④ Control Formulas Used in Practice

Control formulas for controlling the physically modelled sound source saxophone algorithms will be presented below in consideration of the points in items ① to ③ above.

The saxophone algorithm is characterized by its tone generation region and a vibrator method. A case will be exemplified below wherein a tone generation region boundary is approximated by two parabolas.

(i) Feature of Saxophone Algorithm

Figure 4:
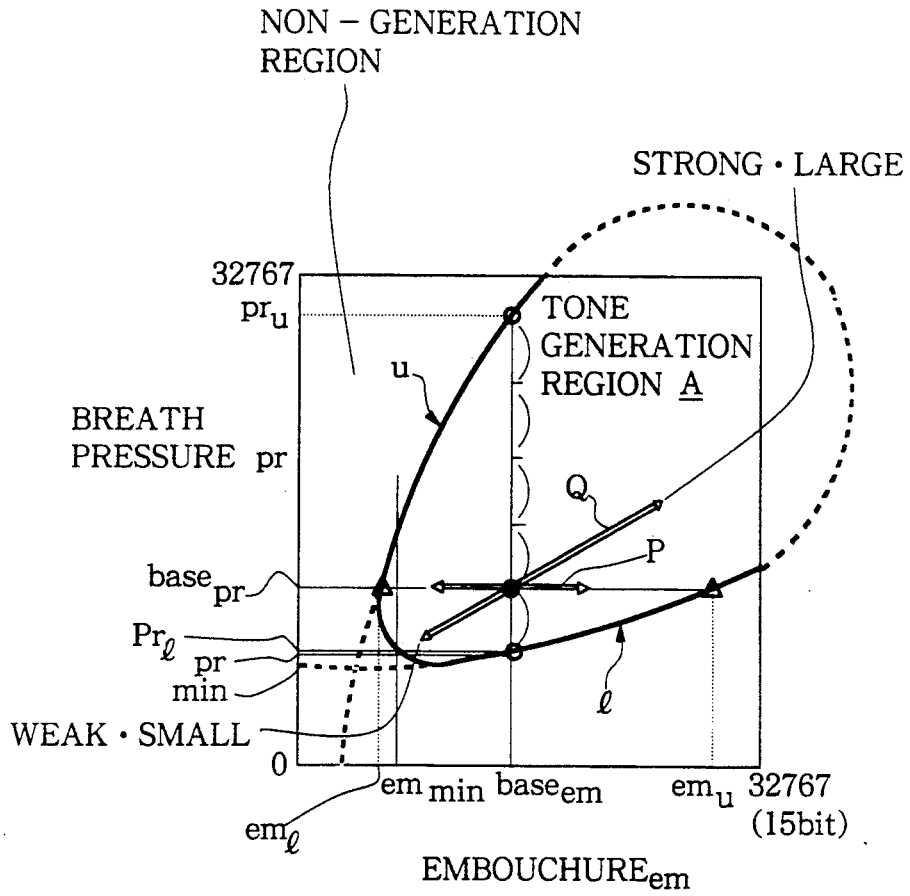

Prior to a description of control formulas used in practice, the feature of the saxophone algorithm will be described below. When an embouchure (em) is plotted along the abscissa and a breath pressure (pr) is plotted along the ordinate, the tone generation region has an inclined egg-like pattern, as shown in FIG. 4. A vibrato effect of the saxophone is attained by adjusting the embouchure, and a tone strength is changed by simultaneously adjusting the breath pressure and the embouchure. When the vibrato effect is attained, musical tone parameters are varied in a direction of a bold arrow P in FIG. 4. When a tone level is changed, musical tone parameters are varied in a direction of a bold arrow Q in FIG. 4.

Therefore, the following control is required. That is, when the parameters are varied in the direction of the bold oblique arrow Q within the tone generation region A shown in FIG. 4 on the basis of, e.g., velocity and pressure data of the slide volume, a tone volume and a tone strength are increased/decreased, and only the embouchure is changed within the tone generation region on the basis of vibrator data such as lateral vibration data of the lateral vibration keyboard so as to obtain the vibrato effect.

(ii) Variables, Boundary Curves

As described above, the tone generation region is approximated by two parabolas u and l. Coefficients of these two parabolas are represented by au, bu, cu, al, bl, and cl. A breath pressure parameter of the sound source is represented by pr, an embouchure parameter is represented by em, and minimum values of these parameters necessary for tone generation are respectively represented by $pr_{min}$ and $em_{min}$. Of the sound source parameters pr and em, basic components for increasing/decreasing a tone volume and a tone strength are represented by $base_{pr}$ and $base_{em}$ (indicating coordinates of a black dot in FIG. 4), and a vibrator component is represented by $vib_{em}$.

Furthermore, pr coordinates of a point (white dot) on the parabolas u and l for $em = base_{em}$ are represented by $(pr_u, pr_l)$, and em coordinates at a point (Δ) on the parabolas u and l for $pr = base_{pr}$ are represented by $(em_u, em_l)$.

$$\text{Parabola } u\text{: } pr = au \times em2 + bu \times em + cu \quad (10)$$

$$\text{Parabola } l\text{: } pr = al \times em2 + bl \times em + cl \quad (11)$$

The velocity and pressure of the slider volume are respectively represented by slspeed and slpress, and lateral vibration data of the keyboard is represented by keyvib.

(iii) Control of Tone Volume and Tone Strength

The parameters pr and em are varied as indicated by the oblique bold arrow Q in FIG. 4 on the basis of data from the operation member. In this case, the parameters are varied to a point (black dot) at an m-to-1 position between the upper and lower limit $pr_u$ and $pr_l$ of the breath pressure parameter pr.

$$base_{em} = f(\text{slspeed, slpress}) \quad (12)$$

$$= \text{slspeed} \times \text{slpress} \quad (13)$$

$$base_{pr} = pr_l + (pr_u - pr_l) \times 1/(m+1) \quad (14)$$

For $$\begin{cases} pr_l = al \times base_{em}^2 + bl \times base_{em} + cl \\ pr_u = au \times base_{em}^2 + bu \times base_{em} + cu \end{cases}$$

Therefore, formula (14) can be rewritten as:

$$base_{pr} = [(au + m \times al) \times base_{em}^2 + (bu + m \times bl) \times base_{em} + cu + m \times al] \times 1/(m+1)$$

When formula (13) is substituted in this formula, we have:

$$base_{pr} = [(au + m \times al) \times \text{slspeed}^2 \times \text{slpress}^2 \; (bu + m \times bl) \times \text{slspeed} \times \text{slpress} + cu + m \times cl] \times 1/(m+1) \quad (15)$$

$$= g(\text{slspeed, slpress}) \quad (16)$$

Formulas (12) and (16) correspond to formulas (8) and (9) described above. In formula (12), the function f is expressed as the product of two operation member data. However, the present invention is not limited to this. In addition, formula (14) is set as a calculation for causing parameters to fall within the tone generation region. However, the present invention is not limited to formula (14).

(iv) Vibrator Control

When a vibrato effect is to be attained based on the lateral vibration data (keyvib) or by a bend, only the parameter is vibrated within a range between $em_u$ and $em_l$ according to the lateral vibration data (keyvib) ($-1.0 \leqq \text{keyvib} \leqq 1.0$) within the tone generation region having basic pr and em, i.e., the black dot ($base_{em}$, $base_{pr}$) as the center, as indicated by the horizontal bold arrow P in FIG. 4. $em_u$ and $em_l$ are respectively calculated as the following values. That is, from equation (10), $em_u$ is calculated as a value satisfying $em_{min} \leqq em_u \leqq 32{,}767$ (maximum value) of two values given by:

$$em_u = \frac{1}{2 \times au}\left(-bu \pm \sqrt{bu^2 - 4au(cu - base_{pr})}\right) \quad (17)$$

From equation (11), $em_l$ is calculated as a value satisfying $em_{min} \leqq em_l \leqq 32{,}767$ (maximum value) of two values given by:

$$em_l = \frac{1}{2 \times al}\left(-bl \pm \sqrt{bl^2 - 4al(cl - base_{pr})}\right) \quad (18)$$

A vibrato component (change width) $vib_{em}$ of em is given by: if (keyvib > 0)

$$vib_{em}=(eml-base_{em})\ x\ keyvib \quad (19)$$

else $$vib_{em}=(base_{em}-em_u)\ x\ keyvib \quad (20)$$

(v) Output Value and Limiting

If the sum of the respective components is used as a sound source parameter, and the slider pressure slspeed $\neq 0$, the parameters are set not to be smaller than the minimum values for tone generation. These control formulas correspond to formula (3).

$$\begin{cases} pr = \text{base}_{pr} & (21) \\ em = \text{base}_{em} + vib_{em} & (22) \end{cases}$$

if (slspeed ·0)

$$\begin{cases} \text{if } (pr < pr_{min})\ pr = pr_{min} & (23) \\ \text{if } (pr < pr_{min})\ pr = pl_{min} & (24) \end{cases}$$

When the parameters em and pr determined by these control formulas are supplied to the sound source 8, the object of the present invention can be achieved.

Figure 6:
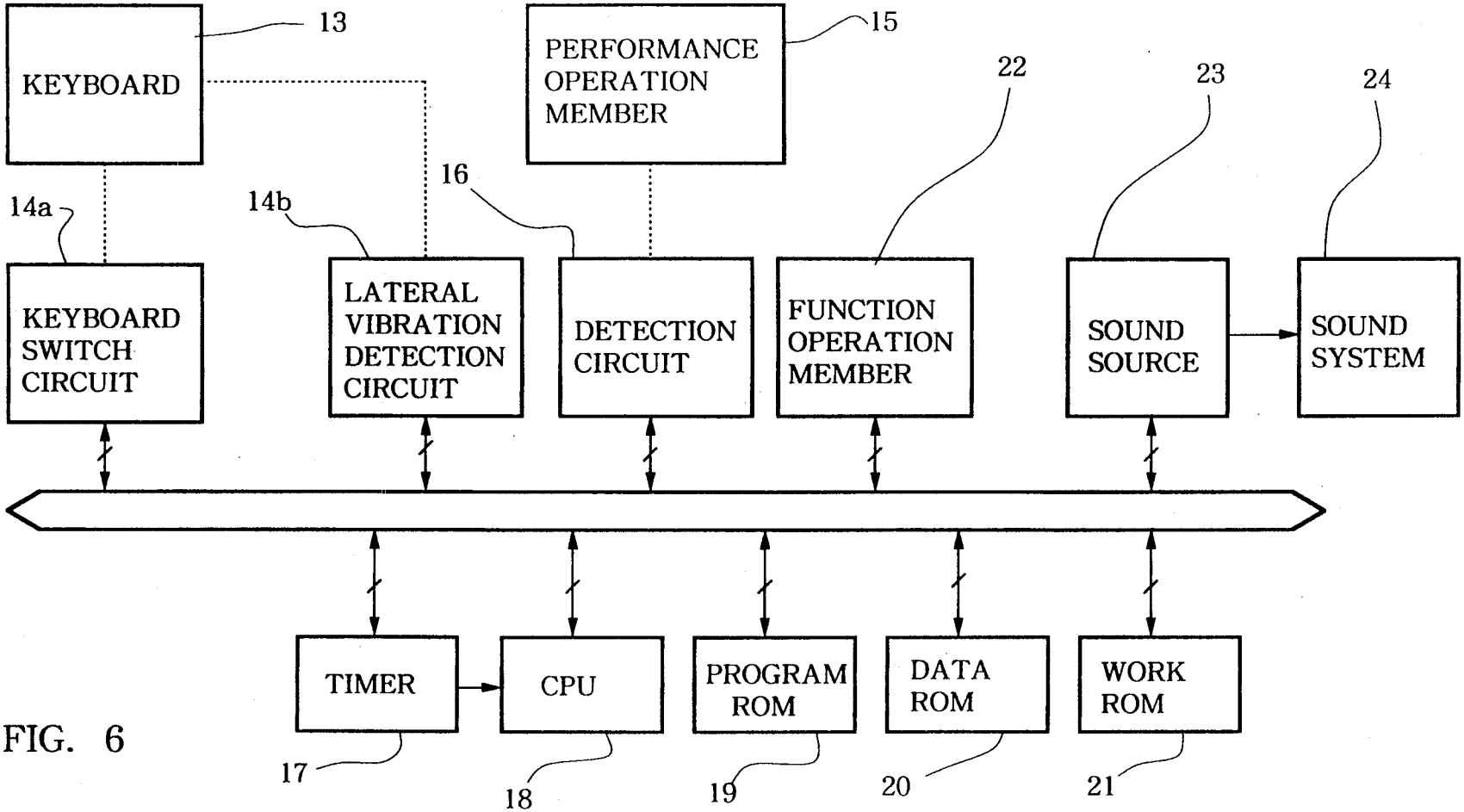
FIG. 6 is a block diagram showing the basic arrangement of an electronic musical instrument to which the mechanism shown in FIG. 1 is applied.

FIG. 6 is a block diagram of a control mechanism for an electronic musical instrument, which comprises the above-described correction circuit.

Figure 7:
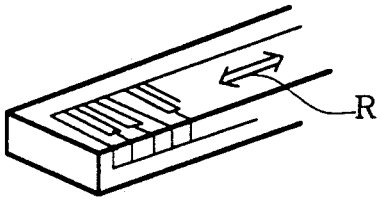
FIG. 7 is a perspective view of a lateral swing or vibration keyboard used as a keyboard shown in FIG. 6.

As a keyboard 13, a so-called lateral vibration keyboard is employed. In this keyboard, each key can be vibrated (or swung) in a lateral direction, as indicated by an arrow R in FIG. 7. A keyboard switch circuit 14*a* detects an ON key at the keyboard 13, and outputs a key code (KCD) indicating the ON key. A lateral vibration detection circuit 14*b* detects a displacement of the keyboard 13 in the direction of the arrow R in FIG. 7, and outputs key vibration data (kv) representing the detected displacement.

Figure 8:
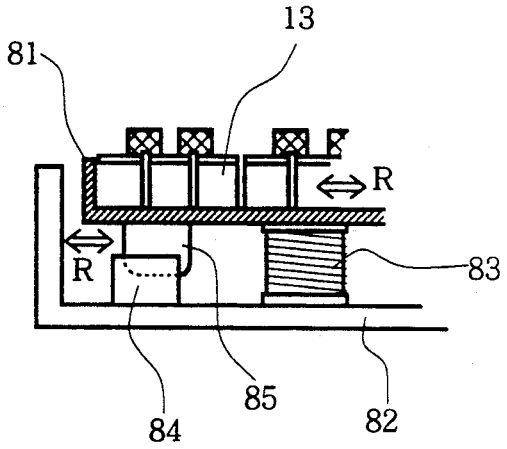
FIG. 8 is a sectional view showing the structure of the lateral vibration keyboard shown in FIG. 7.

FIG. 8 shows an arrangement of the lateral vibration keyboard 13. In FIG. 8, a keyboard frame 81 is laterally swingably supported on a main body frame 82 by a spring 83. A photosensor 84 comprising a light-emitting element for radiating light in a depth direction, and a light-receiving element for detecting the radiated light is arranged below the keyboard frame 81 on the main body frame 82. A shielding plate 84 for changing a light passing amount in the photosensor 84 in accordance with the displacement of the keyboard 13 in the lateral direction (R direction) is arranged under the keyboard frame 81. Thus, when the keyboard 13 is swung in the lateral direction, the output from the photosensor 84 is changed accordingly. The lateral vibration detection circuit 14*b* shown in FIG. 6 detects the lateral vibration of the keyboard 13 on the basis of the output from the photosensor 84, and outputs the key vibration data (kv).

Figure 9:
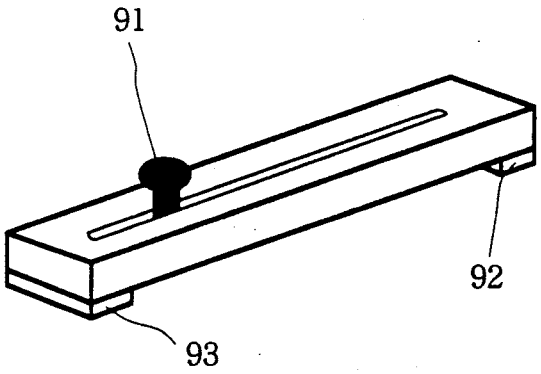
FIG. 9 is a perspective view of a slide volume type performance operation member as an example of a performance operation member shown in FIG. 6.

FIG. 9 shows an arrangement of a slide volume type performance operation member used as a performance operation member 15 shown in FIG. 6. In the performance operation member shown in FIG. 9, a conventional slide volume comprising a knob 91 is mounted on a main body frame or an operation member frame (not shown) to be sandwiched between pressure sensors 92 and 93, so that a pressure on the knob 91 is detected by the pressure sensors 92 and 93.

In FIG. 6, key code data (KCD) outputted from the keyboard switch circuit 14*a*, key vibration data (kv) outputted from the lateral vibration detection circuit 14*b*, and position data and pressure data (ip) outputted from a detection circuit 16 are inputted to a CPU 18 via a bus line. The CPU 18 reads out necessary data from a program ROM 19 for storing routine programs, a data ROM 20 storing data necessary for arithmetic processing, and a work RAM 21 for storing intermediate calculation results of arithmetic processing, and the like, and executes the above-described correction arithmetic operations to calculate parameters (sound source parameters) for musical tone control. A function operation member 22 is normally used for selecting a tone color, a vibrato function, and the like, and for switching between various modes. A timer 17 executes an interrupt routine at a predetermined period of about several ms during execution of the main routine program by the CPU 18.

Figure 10:
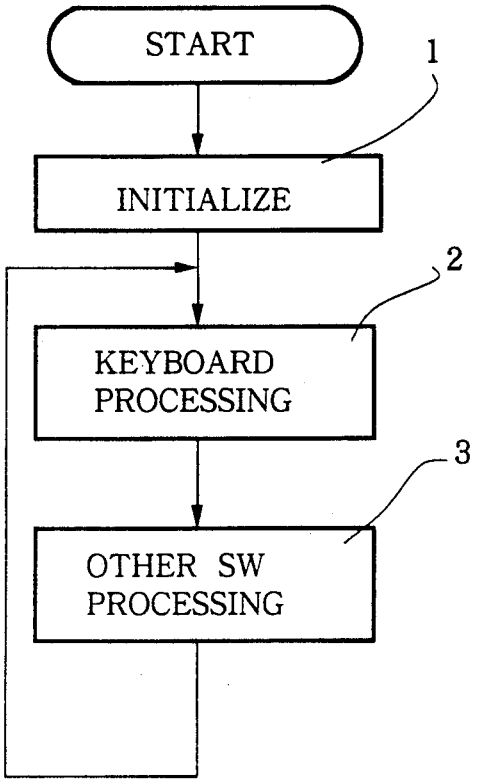
FIG. 10 is a flow chart showing the main routine of program control according to the method of the present invention.

FIG. 10 shows main routine processing executed by the CPU 18 (FIG. 6). In step 1, arithmetic circuits are initialized, and sound source parameters are set to be predetermined initial values. Subsequently, keyboard key switch processing (step 2), and other switch processing (step 3) are repeated. The interrupt routine (to be described later) is executed at the predetermined period by the timer 17 in the main routine, thereby executing the above-described correction arithmetic operations.

Figure 11:
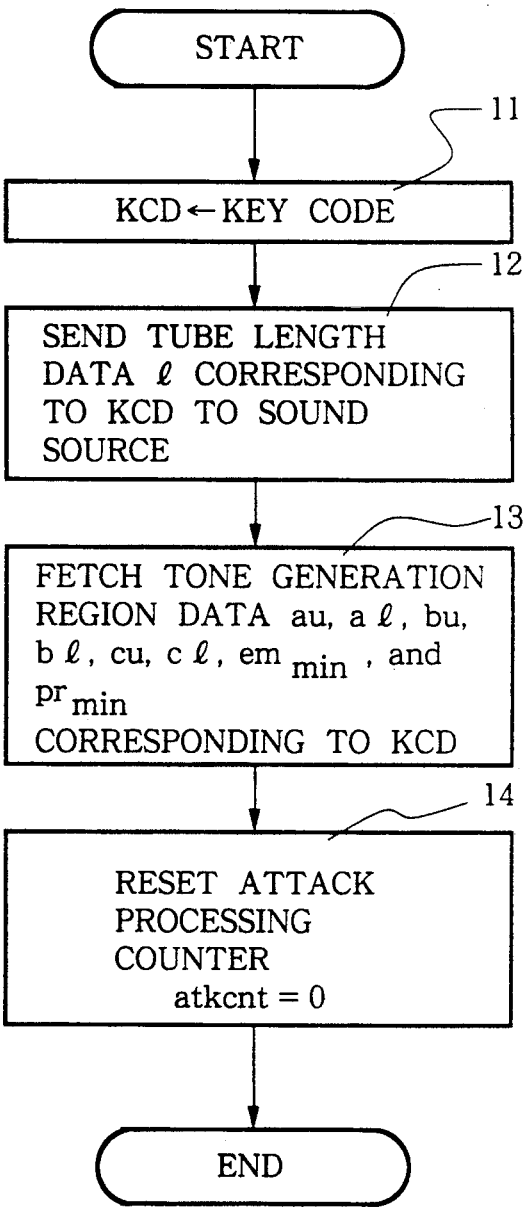
FIG. 11 is a flow chart of a key ON routine.

FIG. 11 shows a key ON routine by the CPU. First, a key code of an ON key is stored in a key code register (KCD) (step 11). Tube length data (l) corresponding to the key code data (KCD) is read out from the data ROM, and is supplied to the sound source (step 12). Tone generation region data (au, al, bu, bl, cu, cl, $em_{min}$, and $pr_{min}$) corresponding to the key code data (KCD) are read out from the data ROM (step 13). Since the tone generation regions are different depending on intervals, the parameters (au, al, bu, bl, cu, cl, and the like) representing the boundary of the tone generation region are stored in the data ROM in units of keys, and are read out in response to a key ON signal. In step 14, an attack processing counter is reset.

In the saxophone algorithm, a tone generation sustain region as a "region where a tone is sustained" is wider than a tone generation start region as a "region where a tone begins to sound" like in the rubbed string instrument. In this embodiment, the tone generation regions are switched in accordance with a count value of the attack processing counter. In step 13 described above, both the tone generation start region data and the tone generation sustain region data are read out as the tone generation region data (au, al, bu, bl, cu, cl, $em_{min}$, and $pr_{min}$), and are stored in the work RAM.

Figure 12:
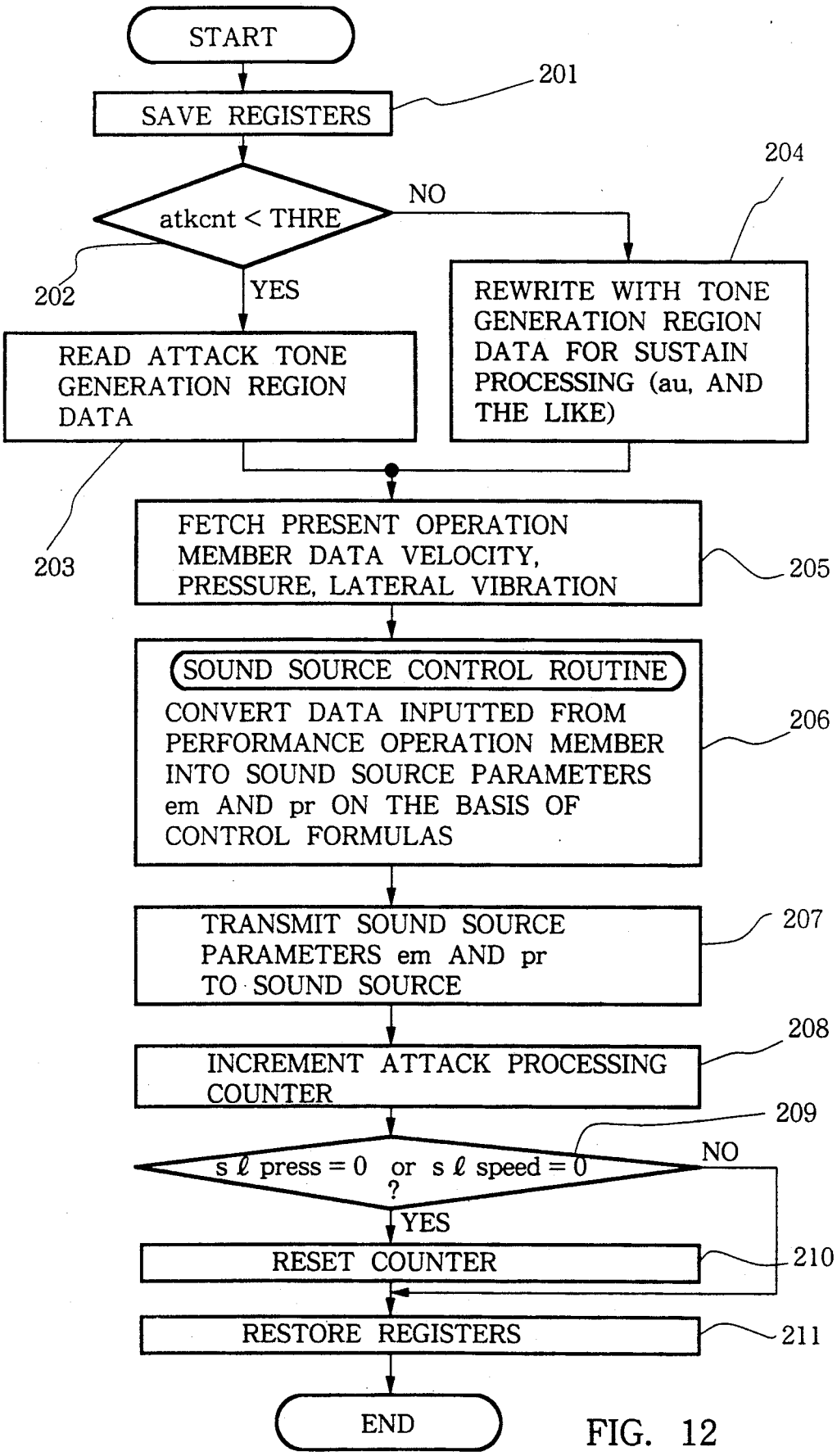
FIG. 12 is a flow chart of a timer interrupt routine.

FIG. 12 shows the interrupt routine which interrupts the main routine at predetermined time intervals in response to fixed clocks. Data in respective registers are saved (step 201), and the count value (atkcut) of the attack processing counter is compared with a predetermined threshold value (THRE) (step 202). If (atkcut)<(THRE), the tone generation start region data are set as the tone generation region data (au, al, bu, bl, cu, cl, $em_{min}$, and $pr_{min}$) (step 203). On the other hand, if (atkcut)≧(THRE), the tone generation sustain region data are set as the tone generation region data (step 204). Subsequently, respective operation member data (slspeed, slpress, and keyvib) are fetched (step 205), and are converted into sound source parameters (em, pr) on the basis of predetermined control formulas in a sound source control routine (to be described later) (step 206). These sound source parameters are transmitted to the sound source (step 207), and the attack processing counter is incremented (step 208). Thereafter, it is checked if the operation member data (slspeed, slpress) are 0 (step 209). If at least one of the data slspeed or slpress is 0, the attack processing counter is reset (step 210); otherwise, the flow directly jumps to processing in step 211 from step 209 while skipping step 210. Thereafter, in step 211, the contents of the registers are restored to states before the interrupt, and the interrupt state is canceled. Thereafter, the flow returns to the main routine.

FIG. 13 shows in detail the sound source control routine executed in step 206. In this sound source control routine, control formulas (13) to (24) for calculating the sound source parameters on the basis of the performance operation member data are the same as those denoted by the same reference numerals described above. Formulas (13) and (14) are those for obtaining a natural relationship between performance operations and tones. In these formulas, both the parameters em and pr are expressed as functions of the operation member data (slspeed, slpress). Formulas (23) and (24) are those for setting lower limits of the sound source parameters. In this embodiment, a tone is sustained as long as a pressure is applied to the slide volume. Formulas (15), (17), and (18) are those for approximating the tone generation region boundary curve by parabolas. The approximated boundary curve can be closer to an original tone generation region than a boundary approximated by straight lines, and a variation range of a tone color can be assured.

Modification of the First Embodiment

In the above embodiment, the saxophone algorithm is used as the physically modelled sound source. However, the above embodiment can be applied to a case wherein other wind instrument algorithms, a rubbed string instrument algorithm, and the like are used.

In the above embodiment, when data (slspeed, slpress, and keyvib) from the performance operation member are corrected according to a predetermined touch curve, electronic tones can be further approximate to man's feeling.

When the tone generation region is widened as much as possible, a variable range of a tone color can be widened, and expression power can be improved. However, this makes the performance operation of the instrument difficult. In contrast to this, when the tone generation region is set to be narrower than an original tone generation region, the instrument can be easy to play, but the variable range of a tone color is narrowed. When data cu, cl, and the like in the above embodiment are adjusted, the difficulty of a performance, and the variable range of a tone color can be controlled.

The pattern of the tone generation region boundary curve changes depending on algorithms. In the above embodiment, the boundary curve is approximated by a parabola as a quadratic function. However, when a boundary curve has a more complicated pattern, or higher approximation precision is required, functions of higher orders may be used, or sampling points of the boundary may be spline-interpolated.

The number of kinds of sound source parameters is not limited to two. For example, the tone generation region also changes depending on other parameters, e.g., a "rubbed string point (position)" in the rubbed string algorithm or a "stiffness of a reed" in the saxophone algorithm. In the above embodiment, a quadratic tone generation region is approximated. However, a cubic or higher region may be approximated.

In the above embodiment, a monophonic system has been exemplified. However, the present invention may be applied to a polyphonic system.

In the above embodiment, the lateral vibration keyboard and the pressure sensitive slide volume are used as the operation members. However, the kinds of operation members are not limited to these. For example, a wind synthesizer type operation member, a tablet type operation member, a stick type operation member, and the like may be used.

A tone color may be selected.

A control mode may be switched between a velocity mode for performing tone generation control in accordance with the operation velocity of an operation member, and a position mode for performing tone generation control in accordance with the position of an operation member.

Second Embodiment

Figure 14:
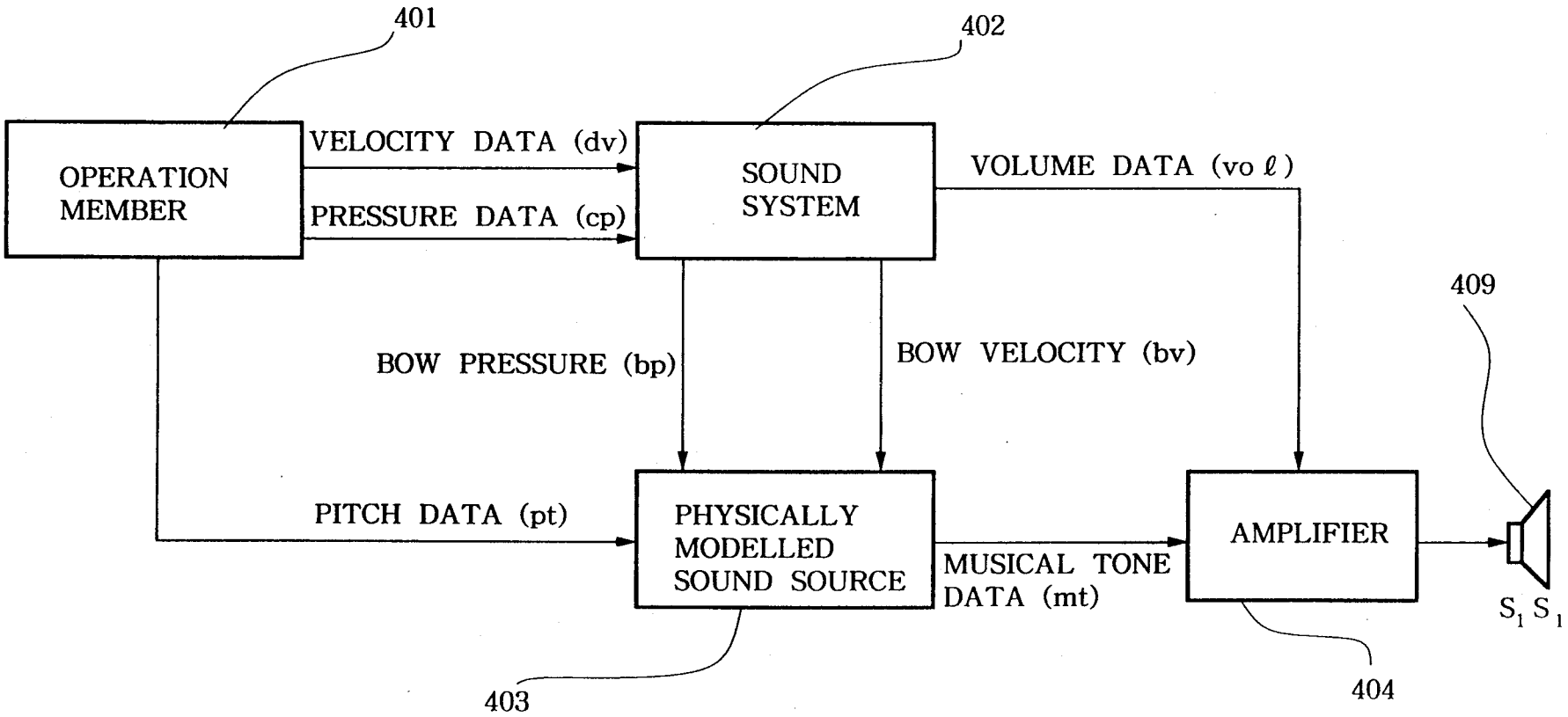
FIG. 14 is a block diagram showing the basic arrangement of an electronic musical instrument according to the second embodiment of the present invention.

FIG. 14 is a block diagram of an electronic rubbed string instrument according to the second embodiment of the present invention.

In FIG. 14, an operation member 401 comprises a performance operation member for inputting bow pressure data and bow velocity data, and a pitch input operation member for inputting pitch data. The performance operation member comprises, e.g., a slide volume comprising a pressure sensitive means, a joystick mechanism, or a mouse mechanism. The pitch input operation member comprises, e.g., a keyboard. The operation member 401 further comprises an A/D converter for converting a position signal and a pressure signal obtained upon operation of the performance operation member into digital position data and pressure data (cp), and a time differential circuit for converting the position data into velocity data (cv). The velocity data (cv) and the pressure data (cp) upon operation of the performance operation member are inputted to a control system 402 as the characteristic feature of this embodiment.

The control system 402 comprises a CPU, and inputs bow velocity data (bv) and bow pressure data (bp) obtained by correcting the velocity data (cv) and the pressure data (cp) to fall within a predetermined tone generation region (tone generation start or sustain region) to a physically modelled sound source 403. The sound source 403 also receives pitch data (pt) according to an operation of the pitch input operation member from the operation member 401. The control system 402 generates volume data (vol) on the basis of the velocity data (cv) and the pressure data (cp), or a conversion (correction) amount when each of these data is converted into the bow velocity data (bv) or the bow pressure data (bp), and inputs it to an amplifier 404.

The sound source 403 comprises a so-called rubbed string algorithm which simulates a mechanical vibration system of a rubbed string instrument by an electrical circuit. The sound source 403 generates musical tone data (mt) on the basis of the bow velocity data (bv), the bow pressure data (bp), the pitch data (p), and the like, and inputs them to the amplifier 404.

The amplifier 404 converts the musical tone data (mt) inputted from the sound source 403 into a musical tone waveform signal, and controls the amplitude of the musical tone waveform signal on the basis of the volume data (vol) inputted from the control system 402. The musical tone waveform signal outputted from the amplifier 404 is produced as an actual tone via a sound system 409. The amplifier 404 can be constituted by a multiplier for multiplying the musical tone signal data (mt) with the volume data (vol), and a D/A converter for converting data outputted from the multiplier into an analog musical tone waveform signal. The multiplier may be replaced with a bit shifter for shifting the musical tone data (mt) to the left or right on the basis of the volume data (vol). Alternatively, after the musical tone data (mt) is D/A-converted without using the multiplier, the amplitude of the musical tone waveform signal may be controlled using a variable gain amplifier.

Figure 15:
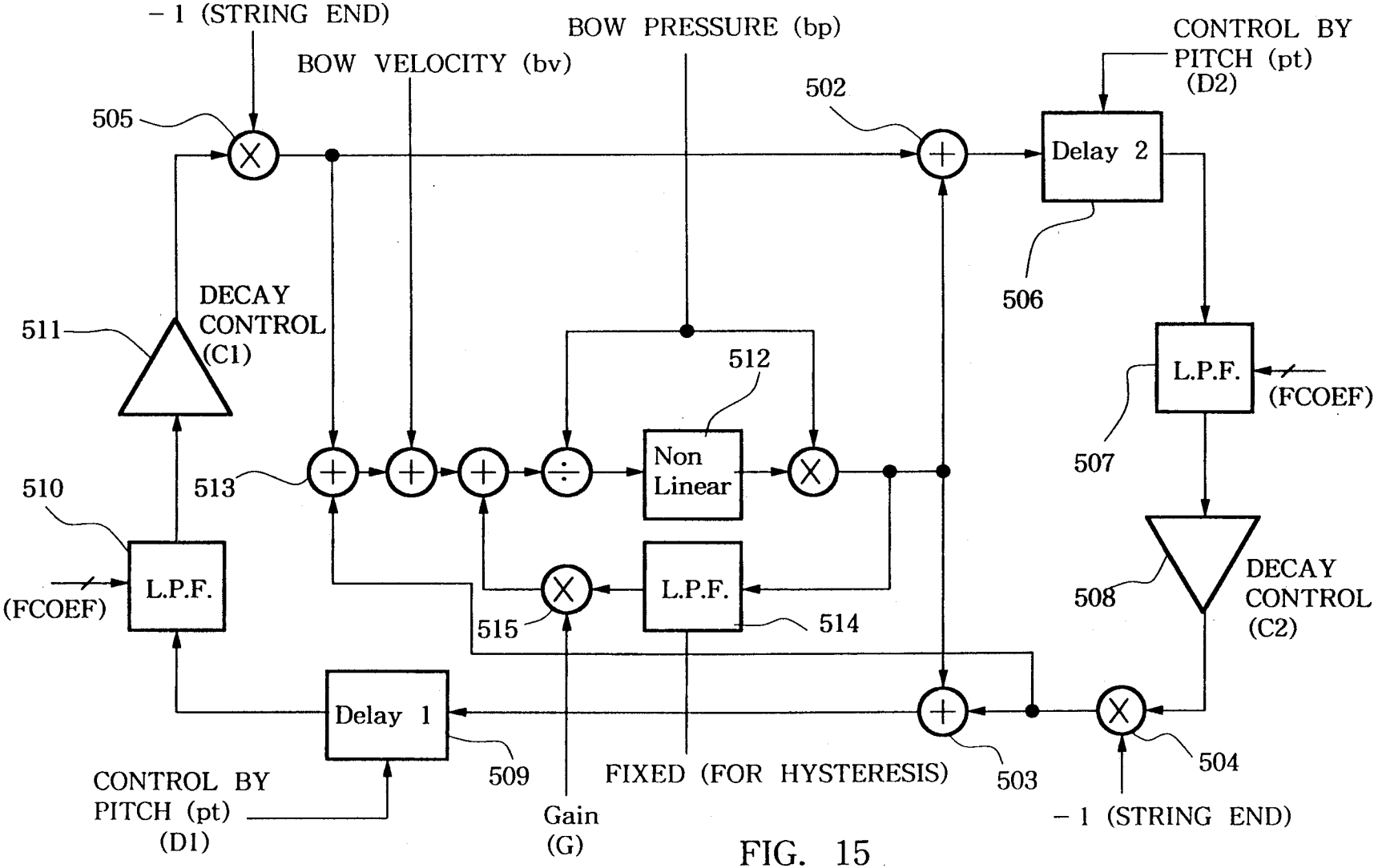
FIG. 15 is a block diagram of a rubbed string algorithm physically modelled sound source.

FIG. 15 shows a circuit arrangement of the rubbed string algorithm sound source used as the sound source 403. In FIG. 15, reference numerals 502 and 503 denote adders which correspond to a rubbed string point. Reference numerals 504 and 505 denote multipliers which correspond to string ends on two sides of the rubbed string point. A closed loop consisting of the adder 502, a delay circuit 506, a low-pass filter 507, an attenuator 508, and the multiplier 504 corresponds to a string portion on one side of the rubbed string point, and a delay time of this closed loop corresponds to a resonance frequency of the string portion. Similarly, a closed loop consisting of the adder 503, a delay circuit 509, a low-pass filter 510, an attenuator 511, and the multiplier 505 corresponds to the other string portion of the rubbed string point. Reference numeral 512 denotes a nonlinear function generator. The nonlinear function generator 512 receives a signal obtained by adding a signal corresponding to a bow velocity (bv) to a signal obtained by synthesizing outputs from the closed loops on two sides of the rubbed string point by an adder 513, and adding the sum signal to a signal obtained by multiplying a signal from a fixed hysteresis low-pass filter 514 with a gain G by a multiplier 515. Hysteresis control of the nonlinear function generator 512 is performed by a signal corresponding to a bow pressure (bp).

Figure 16:
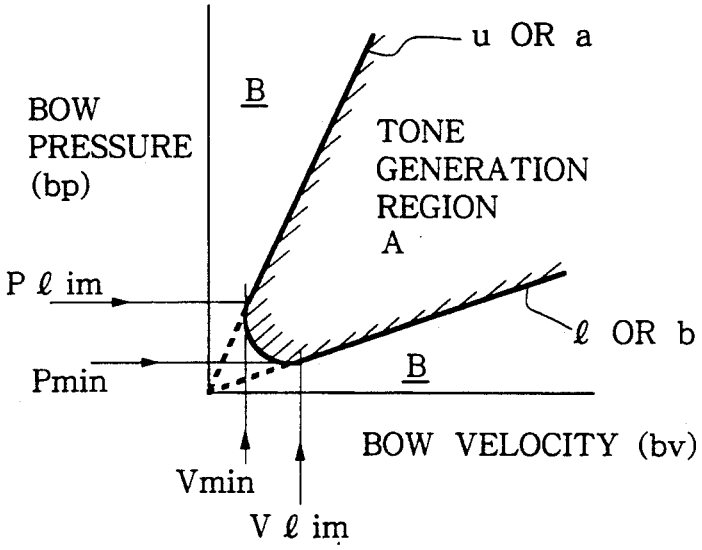
FIG. 16 is a graph showing tone generation region characteristics of the rubbed string algorithm physically modelled sound source.

FIG. 16 shows tone generation (oscillation) region characteristics in a bow velocity (bv).bow pressure (bp) plane of a rubbed string model (rubbed string algorithm). In FIG. 16, a region A inside a hatched portion is a region where a normal musical tone is generated (to be referred to as a tone generation region hereinafter), and a region B outside the hatched portion is a region where no tone is generated, or an irregular tone such as an uncomfortable tone or a so-called falsetto tone is generated if generated (to be referred to as a non-generation region). In a region wherein the bow velocity (bv) and the bow pressure (bp) as the parameters are small, if the bow pressure (bp) satisfies $bp < p_{min}$ or the bow velocity (bv) satisfies $bv < v_{min}$, oscillation is stopped, and tones are intermittently generated. More specifically, smaller tones can no longer be generated, and a dynamic range is narrow.

In this embodiment, when, for example, the bow velocity bv apts to satisfy $bv < v_{lim}$ with respect to a bow velocity lower limit $v_{lim}$ which is relatively small but is set to be sufficiently larger than $v_{min}$, the control system 402 does not supply a value below the limit $v_{lim}$ to the physically modelled sound source, and maintains tone generation while fixing $bv = v_{lim}$. The control system then enters a routine for controlling a tone volume by a volume so as to generate up to small tones.

Figure 17:
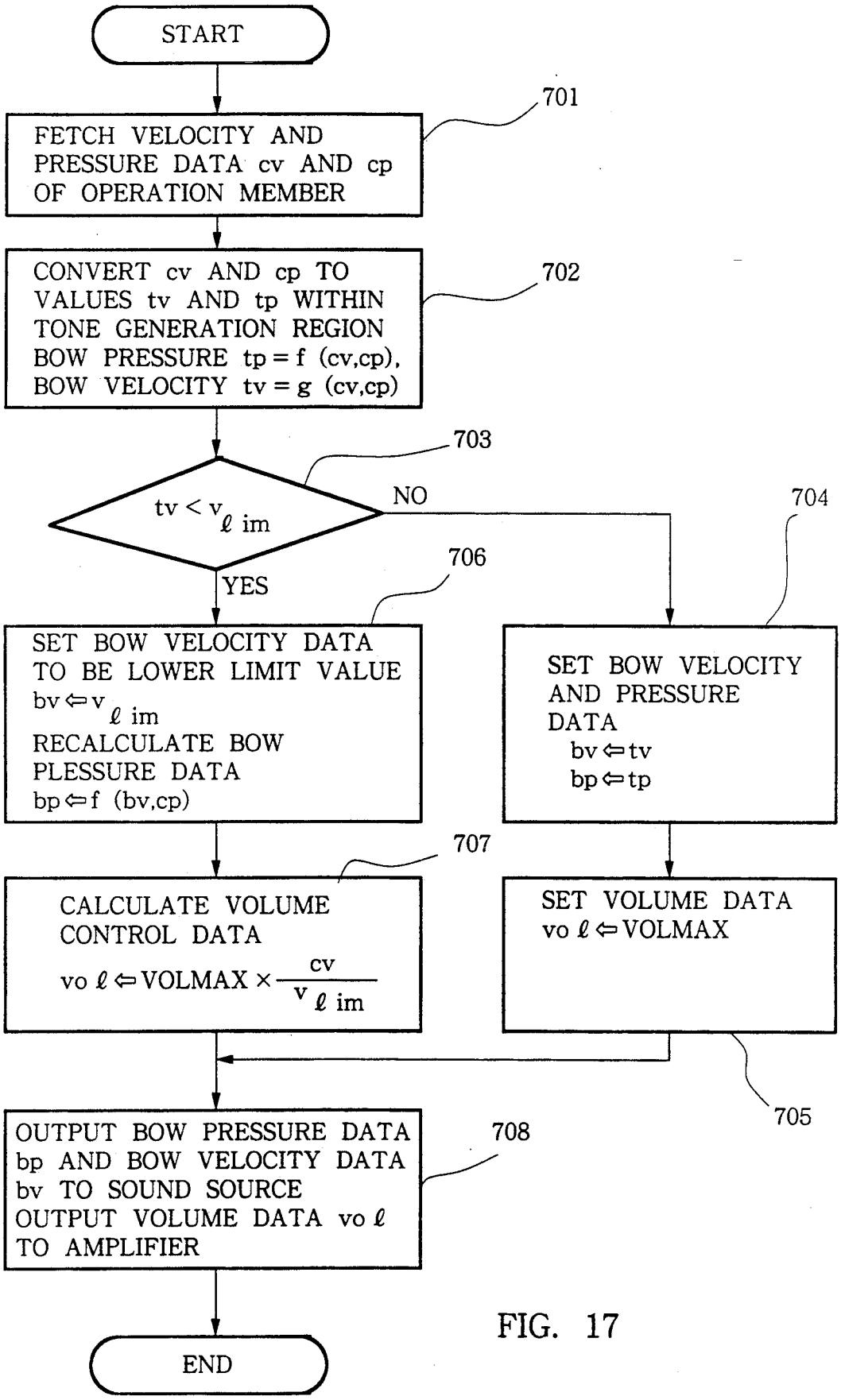
FIG. 17 is a flow chart showing a bow velocity/bow pressure data calculation routine executed in a control system shown in FIG. 14.
Figure 18:
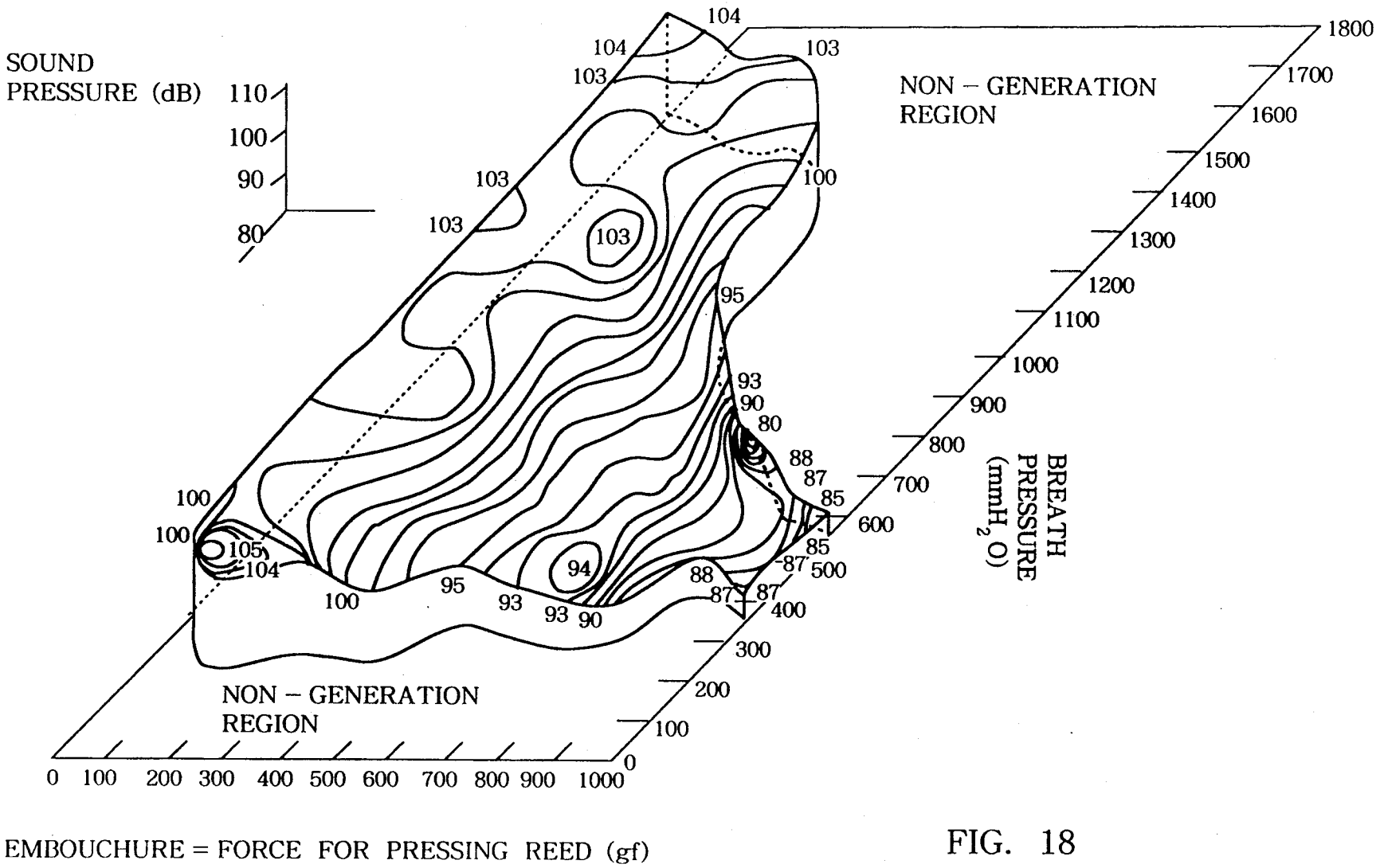
FIG. 18 is a graph showing general tone generation region characteristics of a saxophone.

FIG. 17 shows a bow pressure.bow velocity data calculation algorithm in the control system 402 shown in FIG. 15. The bow pressure bow velocity data calculation is executed in an interrupt routine called at 1-msec intervals.

The control system 402 fetches velocity data (cv) and pressure data (cp) from the operation member 401 (step 701), and converts them into bow velocity data (tp) and bow pressure data (tv) within the tone generation region by the following formulas (step 702):

$$\begin{cases} tp = f(cv, cp) & (31) \\ tv = g(cv, cp) & (32) \end{cases}$$

where f and g are respectively the functions for causing the bow velocity (tv) and the bow pressure (tp) to fall within the tone generation region. The functions f and g are given by, e.g.:

$$\begin{cases} g(cv, cp) = cv \times cp & (33) \\ \text{or } cv + cp & (34) \\ f(cv, cp) = cp_l + (cp_u - cp_l) \times 1/(m + 1) & (35) \end{cases}$$

where $cp_u$ and $cp_l$ are the coordinates along the ordinate with respect to the coordinate cv along the abscissa of the boundary curve of the tone generation region. When the boundary curve of the gone generation region is approximated by parabolas l and u respectively projecting upward and downward, which are given by:

$$\text{Parabola u: } cp = au \times em2 + bu \times em + cu \quad (36)$$

$$\text{Parabola l: } pl = al \times em2 + bl \times em + cl \quad (37)$$

where au, bu, and cu are the coefficients of the parabola u, and al, bl, and cl are the coefficients of the parabola l the coordinates $cp_u$ and $cp_l$ can be expressed by:

$$\begin{cases} cp_l = al \times cv^2 + bl \times cv + cl & (38) \\ cp_u = au \times cv^2 + bu \times cv + cl & (39) \end{cases}$$

Alternatively, as described in the above-mentioned U.S. Ser. No. 07/648,156, the functions f and g may be expressed as:

$$\begin{cases} g(cv) = cv & (40) \\ f(cv) = \{(a + b)/2\} \times cv & (41) \end{cases}$$

or $$\begin{cases} f(cp) = cp & (42) \\ g(cp) = \{(1/a + 1/b)/2\} \times cp & (43) \end{cases}$$

where a and b are the inclinations of straight lines a and b when the boundary curve of the tone generation region is approximated by the two straight lines a and b as follows:

$$cp = a.cv \quad (43)$$

$$cp = b.cv \quad (44)$$

Referring to FIG. 17, when the bow velocity data (tv) and the bow pressure data (tb) are obtained, the control system 402 (FIG. 14) then compares the bow velocity data (tv) with the preset lower limit value ($v_{lim}$) of the bow velocity data (step 703). If the obtained bow velocity data (tv) is equal to or larger than the lower limit value ($v_{lim}$), the control system directly sets the bow velocity data (tv) and the bow pressure data (tp) calculated in step 702 as bow velocity data (bv) and bow pressure data (bp) as musical tone parameters for the sound source 403 (FIG. 14) (step 704), and also sets the volume data (vol) for the amplifier 404 to be VOLMAX as its maximum value (step 705). Thereafter, the control system executes processing in step 708. More specifically, in general, the volume data (vol) is fixed at VOLMAX as its maximum value, and parameters to be outputted to the sound source 403 are changed to provide dynamics.

On the other hand, if it is determined in step 703 that the bow velocity data (tv) is smaller than the lower limit ($v_{lim}$), the control system sets the bow velocity data (bv) to be the lower limit ($v_{lim}$) as the musical tone parameter, and substitutes $bv = v_{lim}$ in formula (31) and also uses formula (32) if necessary, thereby setting the solution (tp) to be the bow pressure data (bp) as the musical tone parameter (step 706). The control system then calculates the volume data (vol) for the amplifier using the following equation (step 707):

$$vol = VOLMAX \times \frac{cv}{v_{lim}}$$

Thereafter, the control system executes processing in step 708. More specifically, when the bow velocity (tv) is smaller than the lower limit value ($v_{min}$), the value of the volume data (vol) is changed within a range of $0 \leqq vol \leqq VOLMAX$.

In step 708, the control system outputs the bow pressure data (bp) and the bow velocity data (bv) set in step 704 or 706 to the sound source 403, and outputs the volume data (vol) set in step 705 or 707 to the amplifier 404. Thereafter, the control system cancels the interrupt state, and returns to the original routine, e.g., the main routine.

Thus, when the operation member is operated with a low velocity (cv) and a low pressure (cp) to play with weak tones such as pianissimo tones, even if they fall outside the tone generation region of the physically modelled sound source 403 unless they are changed, these parameters can be converted to data falling within the tone generation range and the converted data are supplied to the sound source 403. Therefore, the sound source 403 can stably generate tones. Furthermore, since an output volume of the sound source 403 is increased due to this data conversion, the gain of the amplifier 404 is controlled to be decreased, so that a tone volume of a tone produced from the sound system 405 can match with an operation of the operation member 401. In this manner, weak tones which cannot be generated by a conventional physically modelled sound source, and an acoustic instrument can be produced, and the dynamic range of musical tones to be generated can be widened.

Modification of the Second Embodiment

In the above embodiment, the rubbed string instrument algorithm is used as the physically modelled sound source. However, the present invention can be applied to a case wherein wind instrument algorithms such as a saxophone algorithm are used.

The physically modelled sound source suffers from a non-generation region where no tone can be generated since musical tone parameters are too large, or irregular tones such as uncomfortable tones or so-called falsetto tones are generated in addition to the non-generation regions where no tones can be generated since musical tone parameters are too small, as described above. The present invention is applicable to a case wherein the musical tone parameters are too large. For example, in the above embodiment, in place of the maximum value VOLMAX of the volume data used in steps 705 and 707, a standard value VOLSTD of the volume data may be used, and decision step for determining whether or not data tv exceeds an upper limit value $v_{ulim}$ of the bow velocity is added to decision step 703. When the data tv exceeds the upper limit value $v_{ulim}$ of the bow velocity, the flow returns to step 706 to calculate bow pressure data (bp) at that time while fixing the bow velocity data (bv) to be the upper limit value $v_{ulim}$. Thereafter, the volume data (vol) may be calculated in the same manner as in step 707.

Note that the tone generation region may be approximated by a circle or ellipse curve.

What is claimed is:

1. A method for controlling a sound source in an electronic musical instrument, comprising the steps of:

outputting at least two kinds of operation data of a performance operation member in correspondence with at least two musical tone parameters in a musical instrument, an operation range for the performance operation member including a first region corresponding to combinations of values of the operation data designated as a tone generation region and a second region corresponding to combinations of values of the operation data designated as a non-generation region, wherein a boundary between the tone generation region and the non-generation region is defined by one or more curves;

converting the operation data outside of the tone generation region into values falling within the tone generation region; and inputting the converted operation data to the sound source, which generates a musical tone waveform signal in response to the converted operation data.

2. A method according to claim 1, wherein the converted operation data are respectively obtained as functions of the plural operation data and respectively correspond to the musical tone parameters.

3. A method according to claim 1, wherein the tone generation region is determined by two quadratic functions which represent the relationship between two of the musical tone parameters.

4. A method according to claim 3, wherein said musical instrument is a rubbed string instrument and said two musical tone parameters are a bow pressure and a bow velocity.

5. A method according to claim 3, wherein said musical instrument is a wind instrument and said two musical tone parameters are a breath pressure and an embouchure.

6. A method according to claim 1, wherein said sound source is a physically modelled sound source comprising closed loop means including delay means, and drive signal generation means for receiving a waveform signal outputted from said closed loop means and the converted operation data, for changing the waveform signal in accordance with the musical tone parameters, and for supplying the changed waveform signal to said closed loop means.

7. A method according to claim 1, wherein the performance operation member is one of a joystick, mouse and slide volume device.

8. An apparatus for controlling a sound source of an electronic musical instrument, comprising:

a performance operation means, performed by a player, for generating operation data in correspondence with musical tone parameters of a musical instrument;

detecting means for detecting when the operation data falls outside a tone generation region defined by a relation between two or more of the musical tone parameters, the tone generation region defining a closed region having a boundary formed of one or more curves;

a converting means, connecting to the performance operation means, for converting the detected operation data into values falling within the tone generation region; and sound source means, connecting to the converting means, for generating a musical tone waveform signal in response to the converted operation data.

9. An apparatus according to claim 8, wherein said operation data are plural, and said converted operation data are respectively obtained as functions of the plural operation data and respectively correspond to the musical tone parameters.

10. An apparatus according to claim 8, wherein the tone generation region is determined with two quadratic functions representing the relationship between two of the musical tone parameters.

11. An apparatus according to claim 8, wherein said sound source is a physically modelled sound source means comprising closed loop means including delay means, drive signal generation means for receiving a waveform signal outputted from said closed loop means, and the converted operation data for changing the waveform signal in accordance with the musical tone parameters, and for supplying the changed waveform signal to said closed loop means.

12. An apparatus according to claim 8, wherein the performance operation means is one of a joystick, mouse and slide volume device.

13. An electronic musical instrument comprising:

a sound source for generating a musical tone waveform signal in accordance with at least two input musical tone parameters;

performance operation means for generating at least two operation signals corresponding to the musical tone parameter;

signal correction means for converting the operation signals to values corresponding to a closed tone generation region defined by relationship between said at least two musical tone parameters, the tone generation region having one or more curves as its boundary, and then for inputting the converted operation signals to said sound source as the musical tone parameters; and volume control means for increasing or decreasing the amplitude of the musical tone waveform signal outputted from said sound source in accordance with the converted operation signal.

14. An electronic musical instrument according to claim 13, wherein, when the converted operation signal comes to be smaller than a first predetermined value and is still bigger than a second predetermined value, said signal correction means keeps the converted operation signal being the first predetermined value, and the volume control means controls the amplitude of the musical tone waveform signal in response to the operation signal.

* * * * *